United States Patent [19]

Senfter

[11] Patent Number: 4,910,903

[45] Date of Patent: Mar. 27, 1990

[54] TRIGGER MECHANISM, PARTICULARLY FOR SPORTS PISTOLS

[75] Inventor: Emil Senfter, Lienz, Austria

[73] Assignee: Steyr-Daimler-Puch AG, Postfach, Austria

[21] Appl. No.: 316,457

[22] Filed: Feb. 27, 1989

[30] Foreign Application Priority Data

Mar. 14, 1988 [AT] Austria ..... 680/88

[51] Int. Cl.[4] ..... F41C 19/00

[52] U.S. Cl. ..... 42/69.02; 124/31; 124/76

[58] Field of Search ..... 124/74, 76, 31; 42/69.01, 69.02, 41, 42.01, 16, 39.5

[56] References Cited

U.S. PATENT DOCUMENTS

| | | | |
|---|---|---|---|
| Re. 27,568 | 1/1973 | Vades et al. | 42/69.02 |
| 3,142,926 | 8/1964 | Morrow | 42/69.01 |
| 3,550,301 | 12/1970 | Shesterikov | 42/41 |
| 3,899,845 | 8/1975 | Wild et al. | 42/69.01 |

FOREIGN PATENT DOCUMENTS

| | | |
|---|---|---|
| 2053006 | 5/1972 | Fed. Rep. of Germany . |
| 499766 | 1/1971 | Switzerland . |

OTHER PUBLICATIONS

Feinwerkbau Bedienungsanleitung–Instructions Modell 2, 1988.

*Primary Examiner*—Harold J. Tudor
*Assistant Examiner*—Michael J. Carone
*Attorney, Agent, or Firm*—Marmorek, Guttman & Rubenstein

[57] ABSTRACT

A trigger mechanism, particularly for sports pistols, comprises a trigger lever, which carries a trigger blade and is biased by a spring having a variable initial stress and opposing the pull-off movement of the trigger lever. The mechanism also comprises a sear, which cooperates with the trigger lever, and a catch lever, which is adapted to retain the spring-loaded striker and to interlock with the sear in a catching position. The trigger lever is movable against the sear against the spring force.

6 Claims, 1 Drawing Sheet

FIG. 1
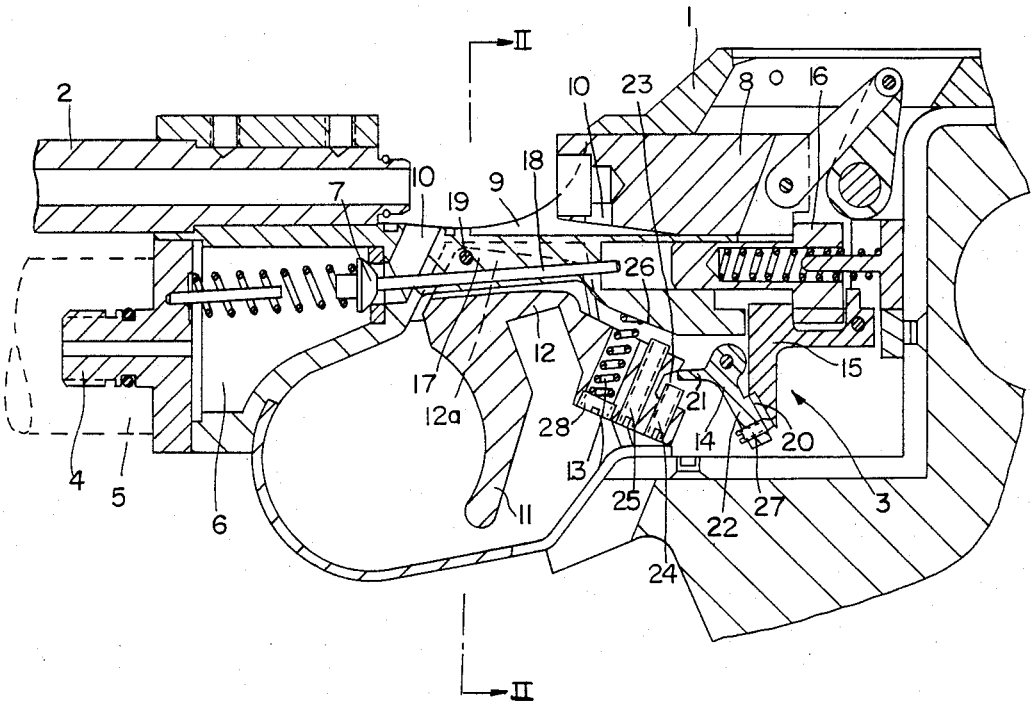
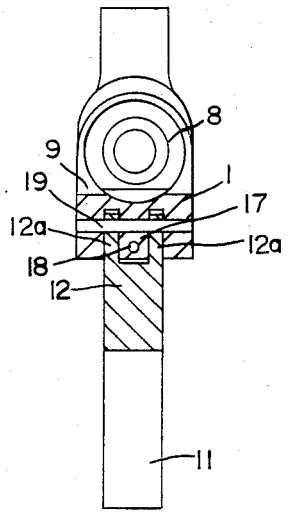
FIG. 2

TRIGGER MECHANISM, PARTICULARLY FOR SPORTS PISTOLS

BACKGROUND OF THE INVENTION

1. Field of the Invention

This invention relates to a trigger mechanism, particularly for sports pistols, comprising a trigger lever, which carries a trigger blade and is biased by a spring having a variable initial stress and opposing the pull-off movement of the trigger lever, also comprising a sear, which cooperates with the trigger lever, and a catch lever, which is adapted to retain the spring-loaded striker and to interlock with the sear in a catching position, wherein the trigger lever is movable against the sear against the spring force.

2. Description of the Prior Art

In a known trigger mechanism of that kind (Feinwerkbau, Bedienungsanleitung-Instructions Modell 2), that arm of the trigger lever which extends away from the trigger blade extends into a mouth formed in the sear and bears on one of the legs defining that mouth. That leg is supported from below by an adjusting screw. The detent means for interlocking with the catch lever are provided on the forwardly facing side of the sear so that the latter constitutes a one-armed lever. That lever is provided with a rearwardly directed extension, which is engaged by a spring, which tends to rotate the sear against the adjusting screw and which cooperates with another adjusting screw. During the movement of the rearwardly extending lever arm of the trigger lever in the free space of the mouth of the sear the spring prevents a release of the catch which is in its catching position. The adjusting screw which is engaged by one of the mouth-defining legs serves only to change the overlap of the catch lever and the sear when they interlock, i.e., to change the pull-off resistance. The initial angular movement of the trigger blade and trigger lever to the pull-off position is defined only by the width of the mouth formed in the sear and undesirably cannot be changed. The additional adjusting screw which cooperates with the rearwardly directed extension of the sear serves to limit the pivotal movement performed by the trigger lever to a position over the sear under the spring force. That additional adjusting screw thus constitutes a so-called trigger stop. The spring which biases the sear obviously increases the structural expenditure.

DE-A-No. 2 053 006 discloses a trigger mechanism in which the trigger lever is formed with an axially adjustable pull-off cam, which extends toward the overlying arm of the sear, and an advancing cam. The pivot for the trigger lever is movably mounted in a positioning plate, which is displaceable relative to the housing of the trigger mechanism approximately in the direction of the forwardly directed arm of the sear and can be fixed in position. Upon a displacement of the positioning plate the advancing cam will slide on the associated arm of the sear and the distance between the advancing cam and the pivotal axis of the sear will be changed as well as the lever ratio of the sear and the force which is required to release the round, i.e., the so-called trigger pull weight. But the positioning plate and the associated clamp screw add to the structural expenditure and the weight of the shooting arm. Besides, it is difficult to effect an exact adjustment. The initial angular movement of the trigger blade and trigger lever to the pull-off position undesirably cannot be changed. Whereas it is also known to provide a mouth in the sear of a trigger mechanism (CH-A-No. 499 766), that mouth acts directly on the catch lever and also cannot be adjusted. In both cases the overlap of the interlocking members cannot be changed to influence the pull-off resistance.

SUMMARY OF THE INVENTION

It is an object of the invention to eliminate the disadvantages outlined hereinbefore and so to improve the trigger mechanism described first hereinbefore that it is simplified in structure and permits of an adjustment also of the initial pivotal movement to the pull-off position and of the pull-off resistance.

That object is accomplished in that the sear consists of a two-armed lever, one arm of which is engaged by the trigger lever and the other arm of which is provided with the detent means for interlocking with the catch lever.

As a result of that arrangement and design, a single spring, which biases the trigger lever, is sufficient in the entire trigger mechanism so that the structure will be simplified. If that spring has a sufficient initial stress so that its spring force is sufficiently strong, the interlocking elements need not overlap when the striker is cocked but the catch lever will be held in its catching position by the friction which owing to the initial stress exists between the sear and the catch lever. In that case a pivotal movement of the trigger blade will not be required but a pressure applied to the trigger blade will be sufficient to release the round.

In accordance with a further feature of the invention that arm of the sear which is engaged by the trigger lever extends into a mouth of the trigger lever and the width of said mouth is variable by means of an adjusting screw.

In dependence on the extent to which that arm of the sear which is engaged by the trigger lever is movable in the mouth of the trigger lever, a larger or smaller initial movement to the pull-off position can be defined for the trigger blade. Because the adjusting screw is mounted in the trigger lever, that screw is easily accessible from the outside. The pull-off resistance can slightly be increased or decreased by a change of the overlap of the interlocking means.

The so-called trigger stop is provided in that an adjusting screw which is directed toward a stop face of the housing of the trigger mechanism is mounted in the trigger lever and serves to limit the pivotal movement of the trigger lever in the pull-off sense. The adjusting screw is desirably carried by the trigger lever and the movement of the trigger lever desirably need not be limited by means of another lever and/or the sear. Besides, it will then be possible to arrange the spring which biases the trigger lever, the screw for adjusting the trigger stop, and the screw for adjusting the width of the mouth in the trigger lever one beside the other so that they are readily accessible from the outside.

In accordance with a further feature of the invention an adjusting screw for varying the overlap of the interlocking elements is mounted in the sear and arranged to act on the catch lever in order to change the overlap of the interlocking elements so that the pull-off resistance can selectively be increased and decreased.

BRIEF DESCRIPTION OF THE DRAWINGS

FIG. 1 is a longitudinal sectional view showing those parts of a gas pressure pistol which are essential for an understanding of the invention.

FIG. 2 is a sectional view taken on line II-II in FIG. 1.

DETAILED DESCRIPTION OF THE PREFERRED EMBODIMENTS

An illustrative embodiment of the invention will now be explained more in detail with reference to the drawing.

The pistol comprises a housing, which is generally designated 1, a barrel 2, which is secured in the housing 1, and a trigger mechanism 3, which is accommodated in the housing 1. A compressed gas contained 5 consisting particularly of a $CO_2$ cartridge is screwed on the tubular port 4, which protrudes from the housing 1 below the barrel 2. As that container or cartridge 5 is screwed to the tubular port 4, the valve of the container or cartridge is opened so that compressed gas from the container or cartridge enters the compressed gas chamber 6, which is closed by a valve 7. FIG. 1 shows the arm in the position which is assumed by the parts when the bolt 8, which is slidable in a track 9, has been pulled back from the rear end of the barrel. In that position of the parts a projectile consisting of a so-called diabolo bullet is inserted into the rear end of the barrel and the bolt 8 is subsequently advanced to close the barrel at its rear end and to establish a communication between the rear end of the barrel and the valve 7 via a passage 10.

The trigger mechanism 3 comprises a trigger lever 12, which carries a trigger blade 11 and is biased by a spring 13, which opposes the movement of the trigger lever 12 in the pull-off sense. The initial stress of the spring 13 can be changed by a screw 28. The trigger mechanism also comprises a sear 14, which cooperates with the trigger lever 12, and a catch lever 15, which is provided with means 20 for interlocking with the sear 14 and which in the illustrated catching position retains the striker 16, which is biased by a spring.

It is apparent that the valve 7 is provided with a striking pin 18, which extends rearwardly in a longitudinal rib 17 of the housing 1 beyond the trigger blade 11 as far as to the striker 16 and that the trigger lever 12 is pivoted on the pivot 19, which is disposed above the striking pin 18 and slightly below the track 9 for the bolt 8. The trigger lever 12 terminates in two legs **12*a*, which extend on opposite sides of the longitudinal rib 17**.

The sear 14 consists of a double-armed lever. One (21) of its arms is engaged by the trigger lever 12 against the force of the spring 13. The other arm 22 of the lever is provided with the detent means 20. The lever arm 21 extends into a mouth 23 of the trigger lever 12. The width of said mouth can be changed by means of an adjusting screw 24 so as to define the extent of the initial movement of the trigger lever 12 to the pull-off position, in which it engages the sear 14. Another adjusting screw 25 is disposed beside the adjusting screw 24 and directed toward the stop surface 26 of the housing 1 and limits the pivotal movement of the trigger lever 12 in the pull-off sense. A further adjusting screw 27 is mounted in the lever arm 21 of the sear 14 and acts on the sear to change the overlap adjacent to the detent means 20.

When the trigger blade 11 is moved in a counterclockwise sense when viewed as in the drawing and a predetermined pivotal movement has been performed, the sear 14 will be pivotally moved so that the detent means 20 will disengage the catch lever 15 and the striker 16 can shoot forward to impinge on the striking pin 18. The round will then be discharged because, e.g., in a gas pressure pistol, the valve 7 which closes the pressure chamber is opened for a short time so that compressed gas flows into the space behind the projectile which has been inserted into the barrel.

I claim:

1. A trigger mechanism for a shooting arm having a spring-loaded striker, comprising:

a trigger lever pivotably movable in a pull-off sense about a first pivot point, a trigger blade carried by said trigger lever, a sear pivotable about a second pivot point, a spring which opposes the pivotal movement of said trigger lever in said pull-off sense and against said sear, means for adjusting the initial stress of said spring, a catch lever which is movable to a catching position, said catch lever interlocking with said sear and being in engagement with said striker to retain said spring-loaded striker in said catching position, said sear comprising a two-armed lever having a first lever arm cooperating with said trigger lever on one side of an axis of rotation defined by said second pivot point and a second lever arm cooperating with said catch lever on an opposite side of said axis of rotation, said trigger lever moving against said first lever arm and causing said sear to pivot about said second pivot point when said trigger lever pivots about said first pivot point, said second lever arm including detent means for interlocking with said catch lever and for retaining said catch lever in said catching position, said detent means being disengaged from said catch lever when said sear is caused to pivot about said second pivot point by movement of said trigger lever against said first lever arm.

2. The trigger mechanism set forth in claim 1, wherein said trigger lever has a mouth, said first lever arm extends into said mouth, and an adjusting screw for adjusting the width of said mouth is mounted in said trigger lever.

3. The trigger mechanism of claim 1 for a shooting arm having a housing in which said trigger mechanism is accommodated, said housing having a stop surface, said trigger mechanism further comprising an adjusting screw mounted in said trigger lever, said adjusting screw being directed toward said stop surface and limiting the pivotal movement of said trigger lever in said pull-off sense.

4. The trigger mechanism of claim 1 comprising an adjusting screw mounted in said sear, said adjusting screw engaging said catch lever and being operable to change the overlap of said detent means with said catch lever in said catching position.

5. The trigger mechanism of claim 1 wherein said sear is unbiased in its direction of rotation.

6. The trigger mechanism of claim 1 mounted in a sports pistol.

* * * * *